United States Patent [19]

Hazelrigg et al.

[11] Patent Number: 4,460,156

[45] Date of Patent: Jul. 17, 1984

[54] WELLHEAD CONNECTOR WITH CHECK VALVE

[75] Inventors: Keith R. Hazelrigg; Edward W. Locheed, Jr., both of Houston, Tex.

[73] Assignee: NL Industries, Inc., New York, N.Y.

[21] Appl. No.: 259,421

[22] Filed: May 1, 1981

[51] Int. Cl.[3] ..... E21B 7/12; F16L 37/28

[52] U.S. Cl. ..... 251/149.3; 137/614.04; 285/25; 285/137 R; 285/325; 166/341; 166/344

[58] Field of Search ..... 166/338, 341, 344, 325, 166/326; 137/614, 614.03, 614.04; 251/149.8, 251/149.3, 339; 285/25, 137 R, 28, 325

[56] References Cited

U.S. PATENT DOCUMENTS

| | | | |
|---|---|---|---|
| 2,893,755 | 7/1959 | Flower | 251/149.3 |
| 3,774,636 | 11/1973 | Arita | 137/614.04 |
| 3,820,600 | 6/1974 | Baugh | 285/26 |
| 3,840,071 | 10/1974 | Baugh et al. | 285/26 |
| 3,957,079 | 5/1976 | Whiteman | 166/388 |
| 4,014,365 | 3/1977 | Peterson et al. | 251/339 |
| 4,310,072 | 1/1982 | Davis | 137/614.04 |
| 4,347,900 | 9/1982 | Barrington | 137/614.03 |

FOREIGN PATENT DOCUMENTS

| | | | |
|---|---|---|---|
| 1780092 | 12/1973 | Fed. Rep. of Germany | 251/149.3 |
| 7216614 | 12/1973 | France . | |
| 1426155 | 2/1976 | United Kingdom . | |
| 1426156 | 2/1976 | United Kingdom . | |
| 1516189 | 6/1978 | United Kingdom . | |
| 78589 | 10/1978 | United Kingdom . | |

*Primary Examiner*—A. Michael Chambers

*Attorney, Agent, or Firm*—Browning, Bushman, Zamecki & Anderson

[57] ABSTRACT

The invention pertains to apparatus for making up fluid connections in association with an underwater wellhead structure. The apparatus comprises a pair of matable bodies including a female body having a generally laterally inwardly facing wall defining a receptacle and a male body adapted for insertion into and removal from the receptacle by movement in a generally longitudinal directional mode. The male body has a generally laterally outwardly facing wall for disposition adjacent the wall of the female body when the male body is inserted therein. Each of the bodies has a respective fluid passageway, and each of these passageways has a port opening through the laterally facing wall of the respective one of the bodies, the two ports being generally in register when the bodies are matingly engaged. A check valve is disposed in the port of one of the bodies, the check valve being biased to a position closing the respective port and having an actuator movable in a generally lateral directional mode to open said port.

9 Claims, 10 Drawing Figures

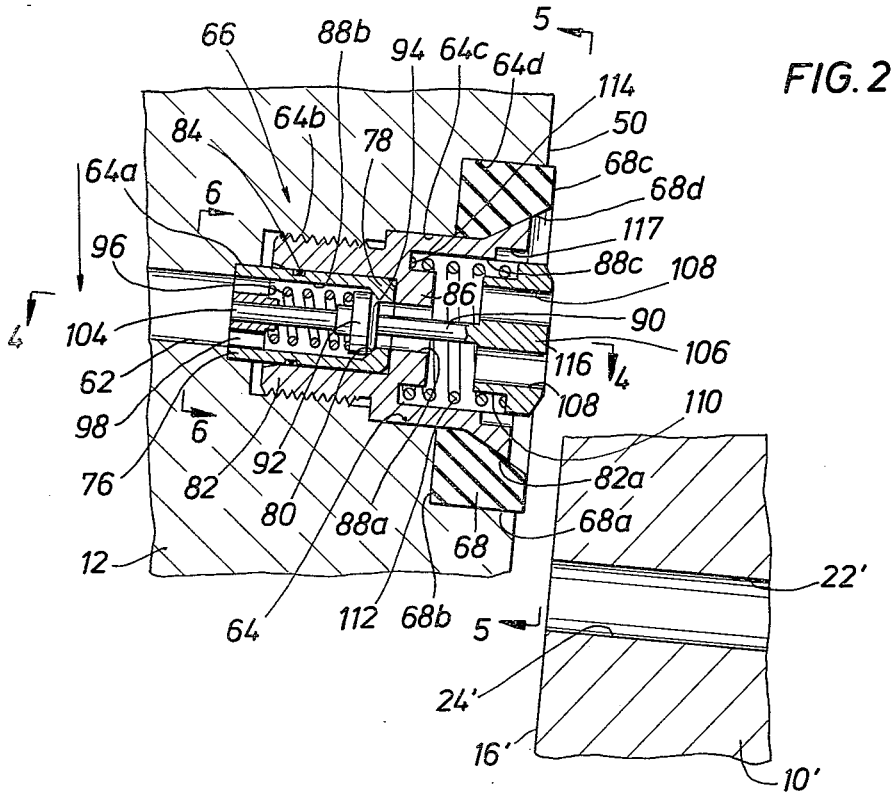
FIG. 2
FIG. 3
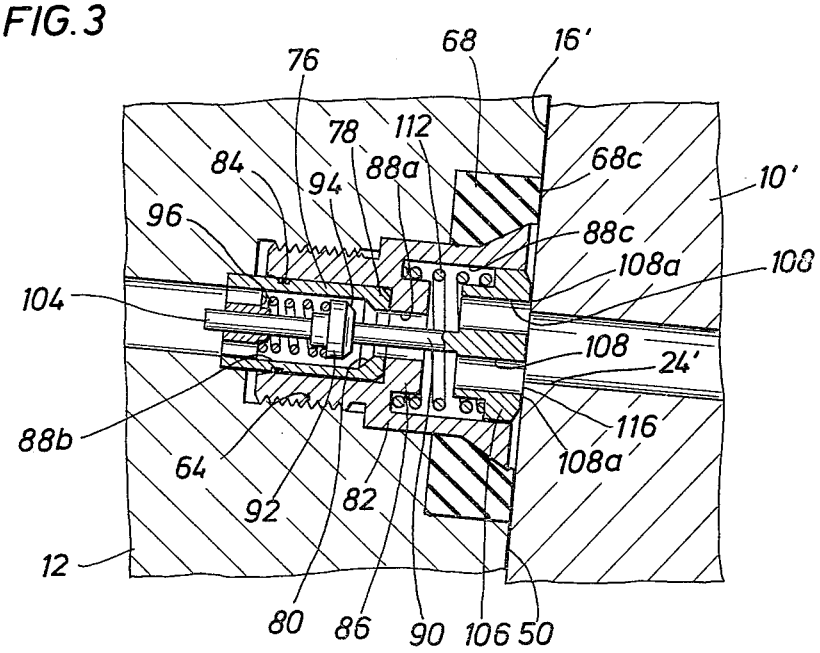

FIG. 4
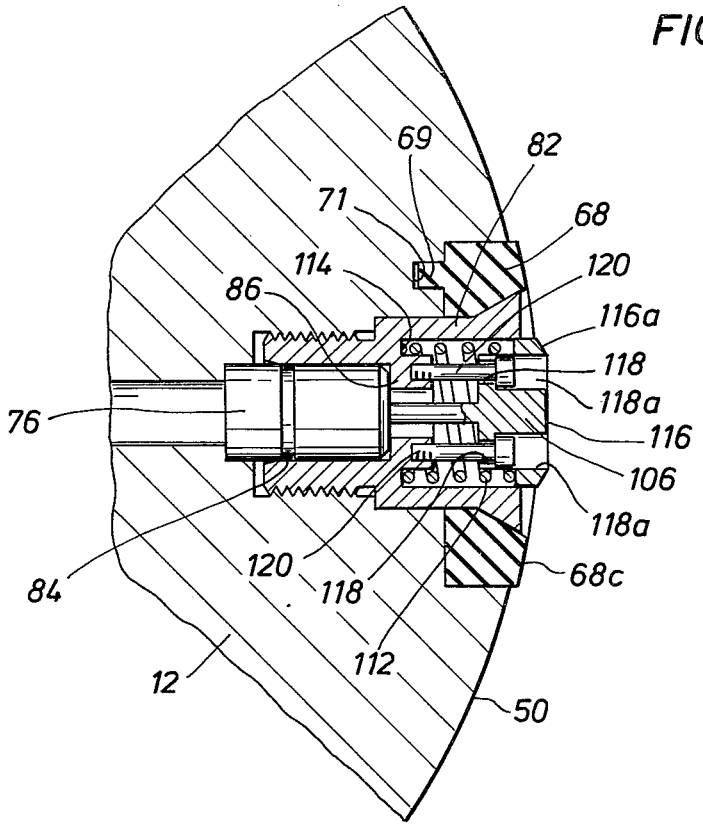
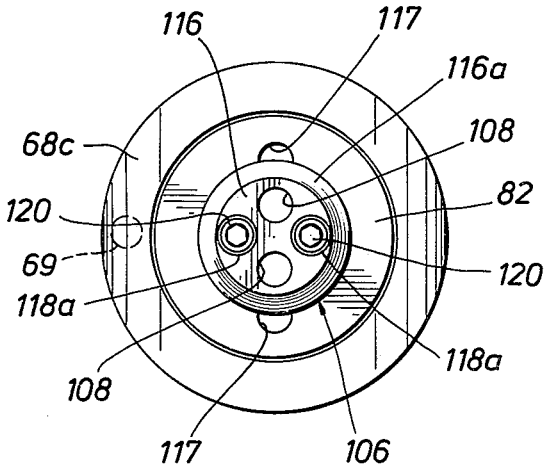
FIG. 5
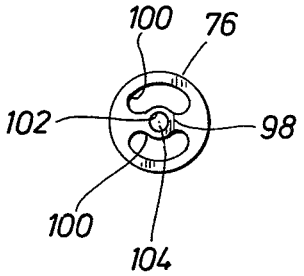
FIG. 6

FIG. 7
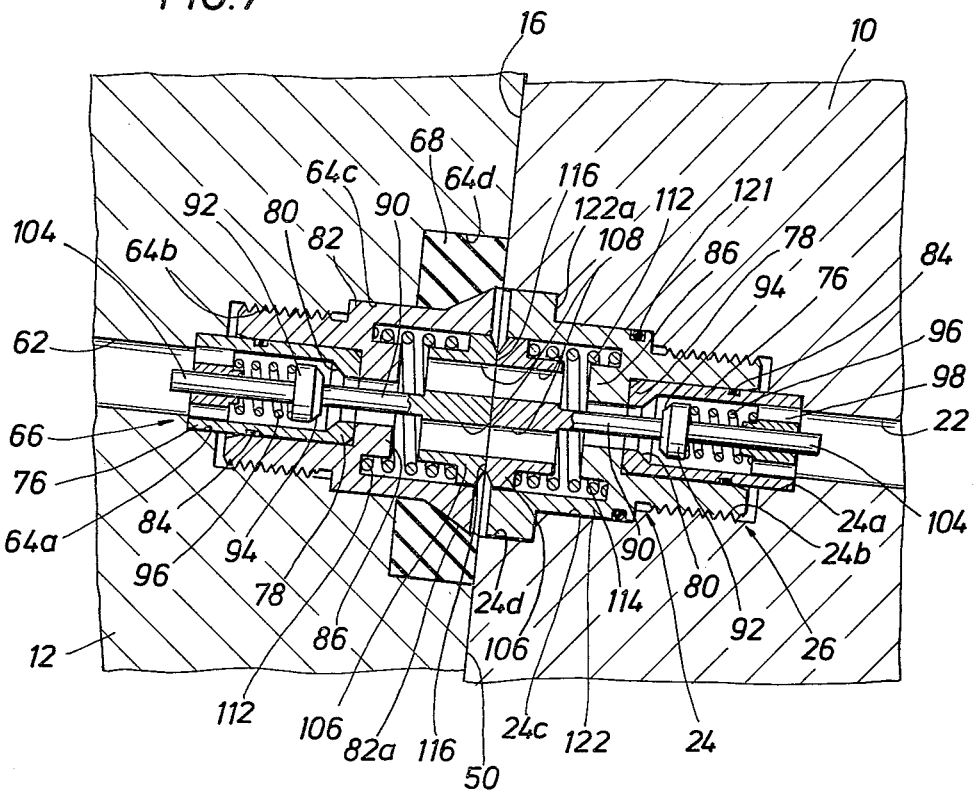
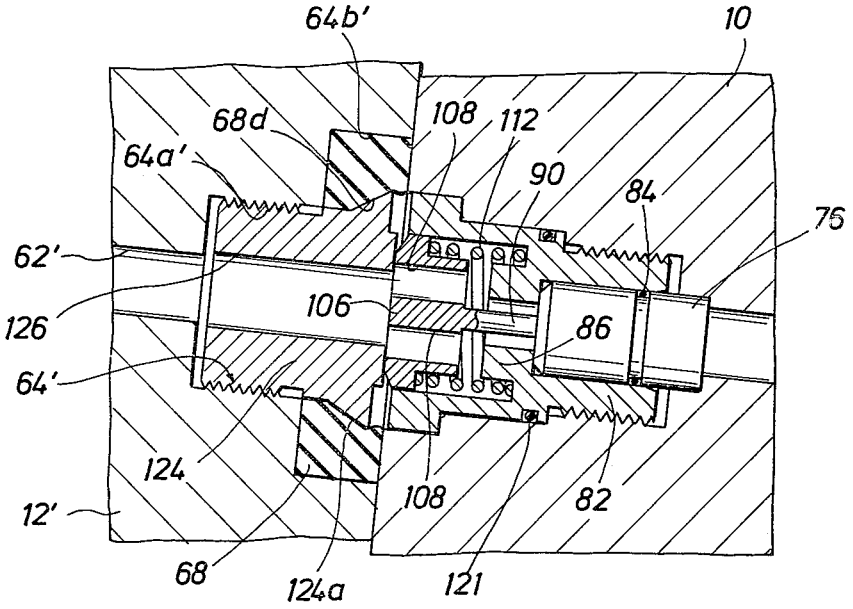
FIG. 8

WELLHEAD CONNECTOR WITH CHECK VALVE

BACKGROUND OF THE INVENTION

The present invention pertains to connector apparatus for making up connections on or about an underwater wellhead structure. Although the general type of apparatus in question can be used for making up either electrical connections, fluid connections, or both, the invention is particularly directed to the fluid, e.g. hydraulic connections. Examples of such apparatus are shown in U.S. Pat. No. 3,840,071 and U.S. Pat. No. 3,820,600. As shown in these prior patents, the type of apparatus involved typically includes at least one female body connected to the underwater wellhead and defining a receptacle and at least one male body for insertion into that receptacle. Each of the bodies of such a mating pair has at least one fluid passageway therein, although more typically, each of the bodies has a number of such passageways. In the apparatus typified by the two prior U.S. patents cited above, the passageways of each male body have ports opening through the laterally outwardly facing side wall of the male body, while the passageways of the female body have respective ports opening through the laterally inwardly facing wall of the female body which defines the receptacle thereof. When the male body is properly seated in the female body, each of its ports registers with a respective port in the female body whereby a number of fluid connections can be made up.

In conventional apparatus of this type, several problems may be encountered. One of these is that, as the male body is lowered downwardly through the water for mating engagement with the female body, a bubble may form and become trapped in its fluid passageway due to the changing pressure. Then, after the bodies are matingly engaged, that bubble is present in the hydraulic communication line which has thus been made up, and can create any number of problems. Another difficulty is that, at any time during which the two bodies are disengaged from each other, e.g. when a male body which has been seated in its respective female body is temporarily removed, hydraulic fluid from one or both bodies can be lost into the sea water and/or the water may contaminate the hydraulic fluid. Finally, in many instances, the total apparatus includes not only one but several such pairs of matable bodies, and the female bodies of two or more of these pairs may be connected in series to a common source of hydraulic fluid. If it is necessary or desirable to remove the male body from one of these pairs, but leave the others engaged, those which remain engaged may be unable to operate properly due to loss of pressure through the one female body from which the male body was removed.

At least one attempt to solve the above problems has been to arrange the fluid passageways so that those of the male body open downwardly through its lower end face and those of the female body open upwardly through the bottom of its receptacle. Then, conventional stab type check valves can be installed in the ports to prevent fluid from flowing inwardly or outwardly through those ports when they are disengaged from those of the other body. An example of the type of check valve referred to above as a "conventional stab type" is illustrated in an advertisement from National Coupling Company, filed herewith.

The last-described arrangement, while at least theoretically solving the problems of fluid loss, pressure loss, bubble formation, and fluid contamination described above, creates a new problem of its own. Because the check valves are of the conventional stab type, each pair of ports, opening longitudinally—rather than laterally—through the two basic matable bodies, itself represents a pair of male and female members which must be properly aligned and mated. Thus, for example, as the overall male body is inserted into the female body, the male member of each check valve must be simultaneously properly stabbed into its respective female counterpart. This requires an extreme degree of precision, not only in the manufacture of the apparatus, but in its positioning, as the primary male and female bodies are engaged, for if even one of the male check valve members is not properly aligned with its respective female member, not only will the respective fluid passageway not be properly connected, but indeed the entire apparatus may be prevented from properly seating, so that none of the fluid connections will be made up.

SUMMARY OF THE INVENTION

The present invention is designed to alleviate all of the problems discussed above through the use, in connector bodies of the general type in question, of check valves which do not require that a male valve member be stabbed into a female valve member. Rather, the valve means in the present invention, while operable by movement of its actuator in a direction generally transverse to the adjacent connector body wall, is so movable by sliding movement of the valve actuator and/or the adjacent connector body wall against another member. Thus, the valve means of the invention can be disposed in ports which open laterally outwardly through the side wall of the connector body, and do not entail the problems of simultaneously inserting a plurality of male members, whose axes are fixed with respect to one another, into a plurality of female members, whose axes are likewise fixed with respect to one another. To put it another way, because the valve means of the present invention are disposed in laterally opening ports and are operable by virtue of the generally longitudinal relative sliding movement between the male and female connector bodies as they are engaged, less precision is needed both in manufacture of the connector bodies and in the connection make-up operation.

While the invention can be incorporated into individual connector bodies designed for use with existing mates and/or systems, even further advantages may be reaped by the design of entire systems in which valve means according to the present invention are incorporated into at least one body of each pair. In some preferred systems, the valve means may be provided in the ports of both bodies of each mating pair.

Another advantage of the present invention is that it can be relatively easily incorporated into existing types of connectors and connector systems, and in particular, can be employed with the same general type of port seals already in use in such systems. In one preferred type of system, resilient annular seals are provided in the ports of the male body of each matable pair. In some embodiments of the present invention, such a seal may simply concentrically surround the outer portion of a check valve means according to the present invention disposed in the same port as the seal. If a check valve is provided in the corresponding port in the female body, the seal in the port of the male body, being oversized both with respect to the port in the female body and to the check valve or valves, can properly engage the connector body wall about the port in the female body, whether valves are disposed in one or the other of the registering ports or both of them. In still another form of the present invention, such a seal may form a part of the valve mechanism itself, more specifically the movable part or valve element.

Accordingly, it is a principal object of the present invention to provide a connector body for use in association with underwater wellhead apparatus and having at least one port opening through the body's generally laterally facing wall means, and a valve in that port operable by virtue of relative longitudinal sliding movement against the generally laterally facing wall means of a mating body.

Another object of the present invention is to provide such a connector body in which the movement of the valve actuator is generally transverse to the wall means through which the respective port opens.

A further object of the present invention is to provide a matable pair of such connector bodies, with such check valve means being disposed in the port or ports of one or both of said bodies.

Still another object of the present invention is to provide a system having a plurality of such pairs of matable bodies, a number of the bodies of such system being interconnected to a common source of fluid and having such valve means therein.

Yet a further object of the present invention is to provide such a connector body, pair of bodies, or system which employs conventional port seals with a minimum amount of modification thereof.

Still other objects, features, and advantages of the present invention will be made apparatus by the following detailed description of preferred embodiments, the drawings, and the claims.

BRIEF DESCRIPTION OF THE DRAWINGS

FIG. 2 is an enlarged detailed sectional view of one embodiment of the invention prior to engagement of the connector bodies.

FIG. 3 is a view similar to that of FIG. 2 but after mating engagement of the connector bodies.

FIG. 4 is a sectional view taken along the line 4—4 in FIG. 2.

FIG. 5 is an elevational view taken along the line 5—5 in FIG. 2.

FIG. 6 is a detailed view taken along the line 6—6 in FIG. 2.

FIG. 7 is a view similar to that of FIG. 3 showing a second embodiment of the invention.

FIG. 8 is a view similar to that of FIG. 3 but showing a third embodiment of the invention.

DETAILED DESCRIPTION

Figure 1:
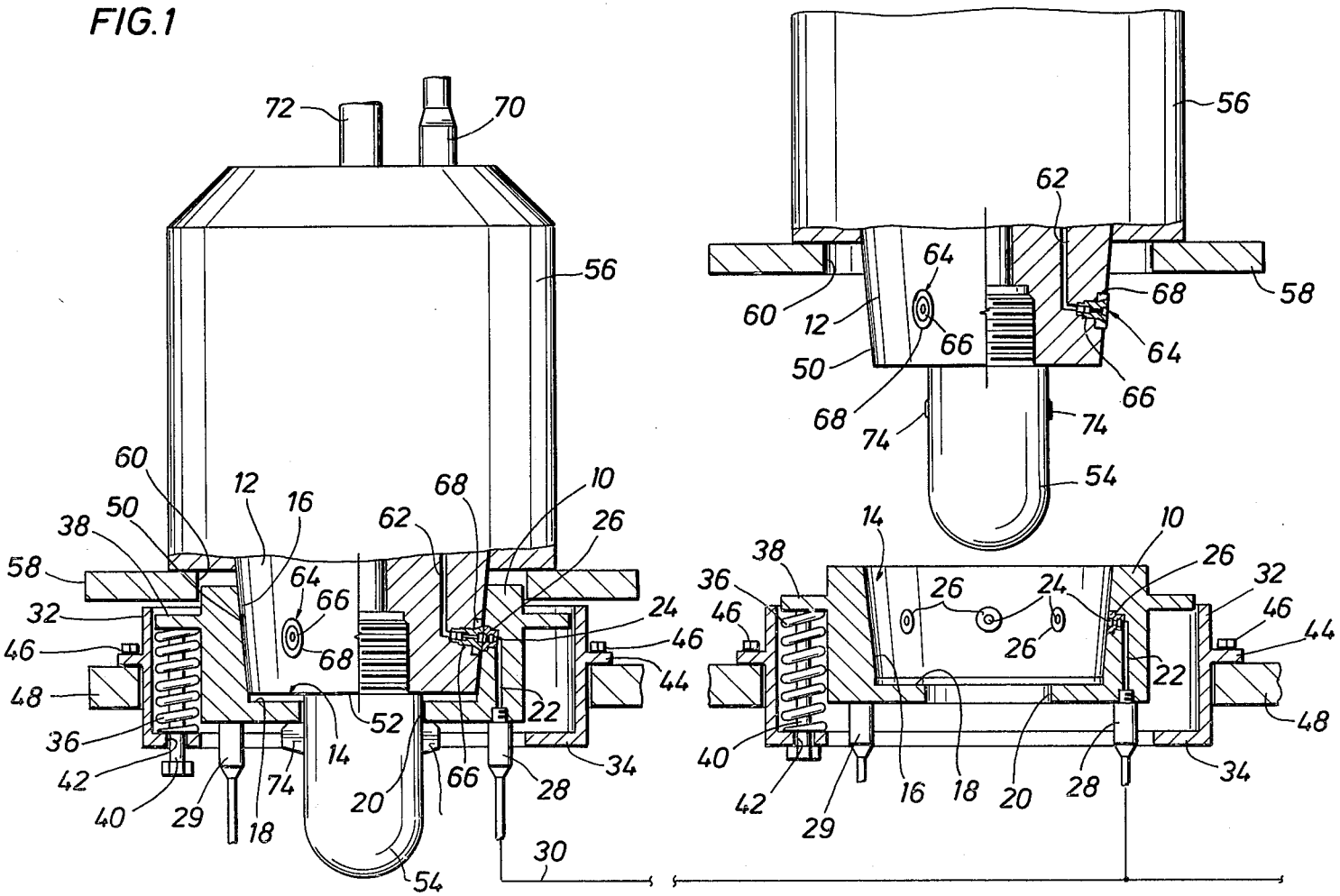
FIG. 1 is a partial side view, with some parts shown in elevation and some parts shown in section, of a system according to the present invention.

Referring to FIG. 1, there is shown a portion of a simplified wellhead connector system. FIG. 1 shows two pairs of matable connector bodies or, "pods" as they are commonly called, although typical systems may include more than two such pairs. Each such matable pair includes a female connector body or pod 10 and a male connector body or pod 12. While the pair of pods 10 and 12 shown on the left hand side of FIG. 1 are matingly engaged, and those shown on the right hand side of FIG. 1 are disengaged, like numbered parts on the two sides of FIG. 1 are otherwise identical in structure.

Each of the female bodies or pods 10 is generally cup-shaped so that it defines an upwardly opening receptacle 14. More specifically the receptacle 14 is defined by a generally laterally inwardly facing frustoconical side wall 16 and a planar, upwardly facing bottom wall 18, wall 18 being interrupted by a central opening 20 extending downwardly through female pod 10. Each female pod 10 has a plurality of fluid passageways therein, one of which is shown at 22. Each such passageway has a port 24 opening through side wall 16 into receptacle 14 and a check valve 26, to be described more fully below, mounted in each port 24. At its opposite end from port 24, each passageway 22 opens through the bottom of the female body or pod 10 and is there connected by means of a fitting 28 to a common hydraulic fluid supply line 30. Line 30 in turn is connected to a suitable reservoir or source of hydraulic fluid. Other fittings such as that shown at 29 connect additional passageways (not shown) in pod 10 to hydraulic lines.

Each female pod 10 is disposed generally within and mounted on a generally cylindrical carrier 32. The carrier 32 has an annular flange 34 extending radially inwardly from its lower end. The inner diameter of flange 34 is sufficiently large to allow access to the underside of pod 10 for connecting fittings 28 and 29. A pair of helical compression springs, one of which is shown at 36, rest on the flange 34 of each carrier 32. Each female body 10 has an integral flange 38 extending radially outwardly therefrom for abutment with the upper ends of springs 36. Thus, each pod 10 is resiliently supported on its carrier 32 by its springs 36 which allow limited vertical play between the pod and carrier. Such play in turn allows for full and proper seating of the respective male pod 12 in the female pod 10. In order to limit upward movement of pod 10 with respect to carrier 32, a stop bolt 40 is associated with each of the springs 36. The end of each bolt 40 is threaded into the underside of the flange 38 on the respective female pod 10. The shank of the bolt 40 extends downwardly from flange 38 through the center of the respective helical spring 36 and through a bore 42 in the flange 34 of the respective carrier 32. The head of the bolt 40 is thus located outside of carrier 32, and as the springs 36 urge the female pod upwardly, the heads of the bolts 40 will abut the underside of flange 34 to limit such upward movement as shown on the right hand side of FIG. 1.

Each of the carriers 32 also has a flange 44 extending radially outwardly therefrom. Flange 44 is attached by screws 46 to a plate 48 having a large central opening surrounding carrier 32. Each plate 48 is in turn secured to a tree structure (not shown) on which the female pod 10 and associated apparatus may be run in. The tree structure in turn is connected to the wellhead by means well known in the art.

Each of the male connector bodies or pods 12 has a generally laterally outwardly facing frustoconical wall 50 configured to parallel and mate with wall 16 of the mating female pod 10 when the male pod 12 is inserted therein. Each male pod 12 also has a downwardly facing lower wall 52 interrupted by a central nose piece 54 extending further downwardly therefrom. An outer housing 56 surrounds the upper portion of pod 12 and rests on a support plate 58 whereby the pod 12 may be run in in a manner well known in the art. Plate 58 has an aperture 60 through which the pod 12 extends, aperture 60 being sufficiently oversized to receive the upper portion of female pod 10 as shown in FIG. 1.

Each of the male pods 12 has a plurality of fluid passageways, one of which is shown at 62 in each of the male pods 12 of FIG. 1. Each such passageway has a port 64, and in each of the ports 64 are mounted a check valve 66 and a resilient annular seal 68, concentrically surrounding the valve 66. Hydraulic fluid lines such as 70 extend through housing 66 to communicate with one or more of the fluid passageways in the respective male pod 12. A running in string or line, diagrammatically indicated at 72, may be used to run the male pod 12 and associated apparatus in for mating engagement with its respective female pod 10. As shown on the left hand side of FIG. 1, the pods 10 and 12 are designed so that frustoconical wall 50 of the male pod will seat on frustoconical wall 16 of the female pod at a point such that lower wall 52 of the male pod is spaced from lower wall 18 of the receptacle of the female body 10. The fact that walls 52 and 18 do not abut insures full proper seating engagement between walls 16 and 50. This in turn insures that each of the ports 64 of the male pod 12 will vertically register with and be sealed with respect to a respective one of the ports 24 in the female pod 10. Other alignment means (not shown, but well known in the art as exemplified by the prior patents cited hereinabove) cooperate between the male and female pods to properly position them circumferentially with respect to each other so that each port 64 at least generally registers with one of the ports 24. When the male pod 12 is properly seated, latches 74 carried by nose piece 54 are extended to engage the underside of female body 10 to prevent upward movement of male pod 12 therefrom. If it is desired to remove the pod 12, latches 74 can be retracted and pod 12 raised as shown on the right hand side of FIG. 1.

As mentioned, in the embodiment shown in FIG. 1, the ports of both the male and female pods have check valves therein. However, in some systems, it may be acceptable, or even desirable, to provide check valves in the ports of only the male pods or, alternatively, in the ports of only the female pods. FIGS. 2–6 illustrate an embodiment in which check valves are provided only in the ports of the male pod, while also illustrating in greater detail the construction of the check valve 66. There is shown that portion of a male pod 12 containing the port 64 of fluid passageway 62, the port 64 opening through the generally laterally outwardly facing frustoconical side wall 50 of pod 12. The portion of the mating female pod 10' shown in FIG. 2 includes the port 24' of the passageway 22' which is intended to communicate with port 64' of the male pod 12'. Port 24' opens through the generally laterally inwardly facing frustoconical side wall 16' defining the receptacle of female pod 10' which receives male pod 12.

The outermost portion of passageway 62 has a plurality of counterbores which make up the port 64. The first or laterally innermost is a smooth counterbore **64*a*, only slightly larger than the diameter of the main portion of passageway 62. Outwardly of section 64*a* is a further enlarged and threaded section 64*b*. Outwardly of section 64*b* is a further enlarged smooth-walled section 64*c*, and finally, there is the outermost smooth section 64*d* of substantially greater diameter. The annular elastomeric seal 68 is disposed in the outermost counterbore 64*d* of port 64. With reference to its own axis, seal 68 has a radially outer cylindrical surface 68*a* which abuts counterbore 64*d*, an axially facing base surface 68*b* which rests on the shoulder formed between sections 64*c* and 64*d* of port 64, a body seal face 68*c* facing axially (and laterally outwardly with respect to pod 12), and a radially inner surface 68*d*. As best seen by comparing FIGS. 2 and 4, seal face 68*c* generally parallels the frustoconical configuration of wall 50 of pod 12. A projection 69 on seal 68 fits into a recess 71 in pod 12 to properly locate seal 68. The outermost portion of radially inner surface 68*d* of seal 68 is flared radially outwardly toward seal face 68*c*. As shown, seal 68 is sized to protrude slightly beyond wall 50 when in a relaxed condition. This insures compression of seal 68 when pods 10' and 12 are matingly engaged, and thus, insures a tight seal against pod 10'**.

The check valve assembly mounted in port 64 includes a housing formed in two separate pieces. The first of these is a relatively small sleeve 76 which rests on the shoulder formed between innermost counterbore section **64*a* and the main body portion of passageway 62, and which extends along port sections 64*a* and 64*b*, in contact with section 64*a* but in radially spaced relationship to the wall of section 64*b*. The outermost end of sleeve 76 (with reference to pod 12 and its port 64) has an integral annular flange 78 extending radially inwardly. Flange 78 defines a frustoconical shoulder 80, facing inwardly with respect to port 64, which shoulder serves as the valve seat area. A larger tubular member 82 forms the remainder of the valve housing means, while also serving to retain sleeve 76 and seal 68 in place. The innermost end of member 82 is threaded into section 64*b* of port 64 in surrounding relation to sleeve 76. Sleeve 76 carries an O-ring 84 in its outer periphery for sealing against housing member 82. Member 82 is provided with recesses 117 for engagement with a tool by which it is threaded into bore section 64*b*. Outwardly of its threaded inner portion, housing member 82 has a larger diameter smooth-walled cylindrical section which abuts section 64*c* of port 64 and the adjacent cylindrical portion of radially inner surface 68*d* of seal 68. Adjacent the flared portion of radially inner surface 68*d* of seal 68, housing member 82 is correspondingly flared, as shown at 82*a*, to retain seal 68 in place. However, said flared end 82*a* of housing member 82 terminates short of wall 50 of pod 12 as well as seal face 68*c* of seal 68 so as not to interfere with compression of seal 68 as it seals against female pod 10'. Housing member 82 also has an internal annular flange 86 which abuts the end of sleeve 76 defined by its flange 78 so that sleeve 76** is properly retained in place.

The two-piece construction of the valve housing means 76, 82 permits the portion thereof which defines the valve seat 80, that being the most critical and also the most easily worn portion of the valve housing, to be replaced as needed without the necessity for replacing the entire housing. Considered as a unit, housing members 76 and 82 define a bore continuous with fluid passageway 62 and its port 64. This bore includes a relatively small diameter section **88*a* defined by the inner diameters of flanges 78 and 86 (which diameters are substantially equal). Inwardly of small diameter section 88*a* (with reference to port 64) is a larger diameter section 88*b* defined by the inner diameter of sleeve 76. On the opposite side of small diameter section 88*a***, i.e.

outwardly of section 88*a* with reference to port 64, there is an even larger diameter section 88*c* defined by the inner diameter of housing member 82.

The check valve assembly further includes a movable portion comprising a narrow cylindrical push rod 90 extending through small diameter section 88*a* of the bore in the valve housing. A circular valve element 92, positioned inwardly of flange 78 of housing sleeve 76, normally abuts rod 90. In alternative embodiments, rod 90 and valve element 92 could be rigidly connected. Valve element 92 radiates from a valve stem 104, and in essence, forms a flange thereon, stem 104 in turn extending inwardly from valve element 92. The end face of valve element 92 which faces or opposes valve seat area 80 is correspondly beveled as shown at 94 to form a valve seal face for sealing engagement with valve seat 80. Since the outer diameter of valve element 92 is greater than the inner diameter of housing bore section 88*a* (and thus the inner diameter of valve seat 80), when valve seal face 94 of valve element 92 engages the valve seat 80 as shown in FIG. 2, flow through the bore of the valve housing, and thus flow through port 64, is blocked. However, if valve element 92 is retracted from valve seat 80 as shown in FIG. 3, then because rod 90 is of substantially smaller diameter than the surrounding section 88*a* of the valve bore, and because the outer diameter of valve element 92 is substantially less than the inner diameter of the surrounding section 88*b* of the valve housing bore, fluid can flow past valve seat 80 and valve element 92.

A helical compression spring 96 is disposed within valve housing sleeve 76 and serves to urge valve element 92 toward valve seat 80 to thereby retain the valve in a normally closed position. As best shown in FIG. 6, sleeve 76 has a web 98 extending diametrically across its inner end. Web 98 provides an abutment for one end of spring 96, but does not completely close off the end of sleeve 76, but rather, leaves diametrically opposed spaces 100 on opposite sides thereof. Web 98 also has a bore 102 concentric with the valve housing bore and slidably receiving valve stem 104. Thus, the interengaged web 98 and valve stem 104 serve as a bearing to guide and properly position the valve element 92. The other end of spring 96 abuts the inner axial end face of valve element 92.

In order to allow the valve element 92 to be moved to its open position as shown in FIG. 3, a large diameter head 106 is integrally formed on the outer end of rod 90. The outer diameter of head 106 is sized for a sliding fit within large diameter bore section 88*c* of the valve housing. Therefore, in order to provide for fluid flow past head 106, it is perforated by diametrically opposed holes 108. Comparing FIGS. 2, 4 and 5, the inner end face of head 106 is undercut as shown at 110 to receive one end of a helical compression spring 112. The other end of spring 112 is received in a recess 114 in housing flange 86. Spring 112 urges the head 106 and attached rod 90 to their outermost position.

As shown in FIGS. 2 and 4, in such outermost position, head 106 protrudes outwardly from port 64 beyond pod wall 50 and also beyond seal face 68*c*. Thus head 106 may serve as an actuator. More specifically, it can be seen that if pod 12 is moved downwardly in a straight vertical direction from the position of FIG. 2, head 106, and more specifically its outwardly facing end face 116, will slidingly engage wall 16' of female pod 10' so that, by the time pod 12 is seated in pod 10' as shown in FIG. 3, the movable portion of the valve assembly will have been urged inwardly to its open position. As shown in FIGS. 4 and 5, head 106 has a second pair of perforations 118 at 90° from holes 108. Perforations 118 slidably receive the shanks of a pair of screws 120 whose ends are threaded into flange 86 of the valve housing. Perforations 118 are counterbored at 118*a* to receive the heads of screws 120. Thus screws 120 serve as stops limiting outward movement of head 106. As best shown in FIG. 4, in order to cause flat end face 116 of head 106 to more nearly conform to the curved transverse cross sectional configuration of wall 50 of pod 12, it is beveled adjacent its outer periphery as shown at 116*a*.

Referring to FIG. 3, it should be noted that the holes 108 through head 106 are spaced apart by a distance much smaller than the diameter of port 24' of female pod 10'. On the other hand, the overall lateral extent of holes 108, i.e. the distance between their most distant points 108*a*, is substantially greater than the diameter of port 24'. This insures communication between port 24' and holes 108 when pods 12 and 10' are mated without the need for extremely precise tolerances. Also, as mentioned above, while the movement of the movable portion of the valve assembly in opening and closing port 64 is generally transverse to the wall 50 through which that port opens, such movement can be accomplished by the relative longitudinal movement between pods 12 and 10' during mating engagement thereof, and more specifically, by sliding of face 116 against wall 16', and without the need for any portion of the valve assembly to be stabbed into or mated with a corresponding member in the female pod. These features cooperate to provide the present invention with the advantages of laterally opening ports, and thus less need for close tolerances, while still retaining the advantages of check valves in various ports of the counter apparatus.

FIG. 7 shows the same male pod 12 and associated check valve apparatus as is shown in FIGS. 2–6, but in engagement with a female pod 10 of which the port 24 of the fluid passageway 22 is provided with its own check valve apparatus 26, as opposed to the more conventional female pod 10' of FIGS. 2–4. Thus, FIG. 7 represents an enlarged detailed view of the embodiment of FIG. 1 in which all ports of both pods are provided with check valve assemblies. In describing the check valve apparatus of pod 10, words such as "inner" and "outer" will be used with reference to port 24, "innermost" being construced as farthest from wall 16 and "outermost" being construed as closest to wall 16. Port 24 has been counterbored and tapped to receive the check valve apparatus 26 in a manner similar to port 64 in male pod 12. More specifically, port 24 includes: an innermost smooth-walled counterbored section 24*a* corresponding in dimensions to section 64*a* of port 64; a threaded section 24*b* corresponding in dimensions to section 64*b* of port 64; a smooth-walled counterbored section 24*c* of the same diameter as, but slightly longer than, section 64*c* of port 64; and finally, an outermost smooth-walled counterbored section 24*d* which, since it does not accommodate a seal such as 68 in the male pod 12, is shorter and of smaller diameter than the corresponding section 64*d* of port 64.

The check valve assembly for port 24 of female pod 10 includes a housing member 122 similar in configuration to housing member 82 in male pod 12 except that, in place of the flared surface 82*a*, member 122 has a 90° shoulder 122*a* so that it follows the configuration of bore sections 24*c* and 24*d* and the shoulder formed therebetween. The innermost end of housing member 122 is threaded into section 24*b* of port 24 to retain the entire valve assembly in place. Because port 24 does not contain a seal such as 68, housing member 122 is sealed to port 24 by an O-ring 121.

The remaining parts of the valve assembly 26 in port 24 of female pod 10 are identical to the corresponding parts of the valve assembly 66 in port 64 of male pod 12; thus, these corresponding parts have been given like reference numerals and will not again be described in detail. Briefly, when the receptacle defined by wall 16 of female pod 10 does not have a male pod engaged therein, springs 96 and 112 will urge the movable portion of the valve assembly 26 to its outermost position in which face 94 of valve element 92 seats on valve seat 80, thereby closing port 24, and head 106 protrudes beyond wall 16 to serve as an actuator for the valve. As the male pod 12 is inserted into the receptacle defined by wall 16, the end face 116 of head 106 of the valve assembly 26 will be slidingly engaged by wall 50 of male pod 12 and/or face 116 of its respective valve assembly so that both actuators 106 will be urged to their inner positions, as shown in FIG. 7, thereby retracting the valve elements 92 from their respective valve seats 80, and consequently opening ports 24 and 64 to communication with each other.

Referring once again to FIG. 1, the pair of pods 10 and 12 shown on the left hand side of the figure are matingly engaged, and the valve assemblies in their various ports 24 and 64 would thus be in open positions as shown in greater detail in FIG. 7. Thus, hydraulic fluid could be communicated from one pod to the other for operating various devices associated with the wellhead structure. The pair of pods 10 and 12 shown on the right hand side of FIG. 1 might represent such a pair of pods as the male pod 12 is being run in for mating engagement with the female pod 10 and prior to mating or seating. The check valves in both of these pods 10 and 12 would be in their closed positions, see FIG. 2. Thus neither pod would lose hydraulic fluid to the environment, nor would the fluid passageways of either pod be contaminated by the seawater. The closure of the check valves 26 in the female pod 10 would likewise prevent pressure loss from common hydraulic line 30 and thereby avoid any interference with proper functioning of the already mated pods on the left hand side of the figure. Finally, the closure of the valves in male pod 12 would prevent the formation of bubbles in its fluid passageways due to pressure change as the pod is lowered. All of the above advantages would likewise be achieved if either of the male pods, after having been seated in its female mate, were withdrawn. Nevertheless, as mentioned above, all of these advantages are achieved through check valves in ports which open laterally through their respective pods, rather than axially, and which operate by virtue of relative longitudinal sliding movement (with respect to the pods as a whole) and without the need for stabbing type engagement at each individual pair of mated ports. Thus the apparatus, in essence, while providing all the advantages described in connection with the use of check valves generally, requires no more precision of machining of the pod walls 16 and 50 nor more precision in the placement of the various ports within those walls than as required in conventional valve-less connectors or pods. It is also noted that the check valves of the present invention are readily associated with more or less conventional seals 68.

As mentioned, while the embodiment of FIGS. 1 and 7 provides maximum advantages in various respects, it may be necessary or desirable in some situations to provide valves in only the male pods or only the female pods in some systems. FIGS. 2–6, described above, depict a system wherein valves are provided only in the male pod. FIG. 8, on the other hand, shows how the invention can be adapted to provide a system in which valves are provided in ports of only the female pods.

More specifically, FIG. 8 shows the same pod 10 and valve assembly 26 as are shown in FIG. 7. Thus, the parts of valve assembly 26 have been given like reference numerals and will not again be described in detail. Engaged in the receptacle defined by pod 10 is a male pod 12' whose port 64' contains a seal and seal retainer, but no valve. More specifically, port 64' has an innermost counterbored tapped section 64*a'* and an outermost smooth-walled counterbored section 64*b'* of even greater diameter than section 64*a'*. Seal 68, identical to that of the other embodiments described hereinabove, is seated in section 64*b'*. A tubular retainer 124 is threaded into section 64*a'* and has an outer smooth portion which generally follows the contour of radially inner surface 68*d* of seal 68, and in particular, includes a flared section 124*a* for retaining seal 68 in place, section 124*a* terminating short of the outer extremity of seal 68 so as not to interfere with deformation thereof for sealing engagement with pod 10. Retainer 124 has a central bore 126 which registers with the remainder of passageway 62'. It is noted that, regardless of whether check valve assemblies are employed in the ports of the male pod, the female pod, or both, it is preferable to provide seals such as 68 in the ports of the male pod only. Thus the various embodiments illustrated in FIGS. 1–8 show how this preferred sealing scheme can be adapted to various systems regardless of which port or ports contain the check valve assemblies.

Figure 9:
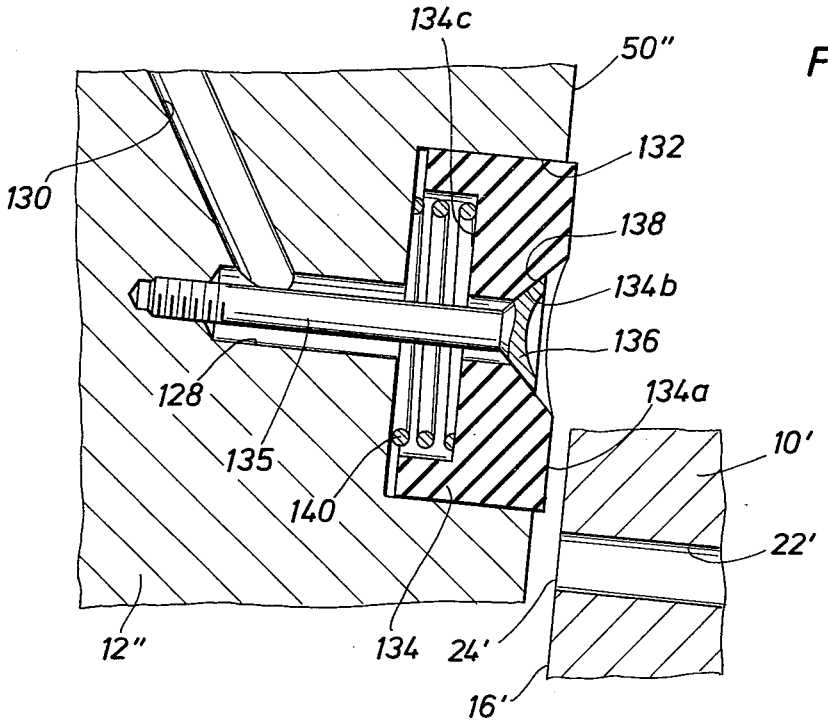
FIG. 9 is a view similar to that of FIG. 2 but showing a fourth embodiment of the invention.
Figure 10:
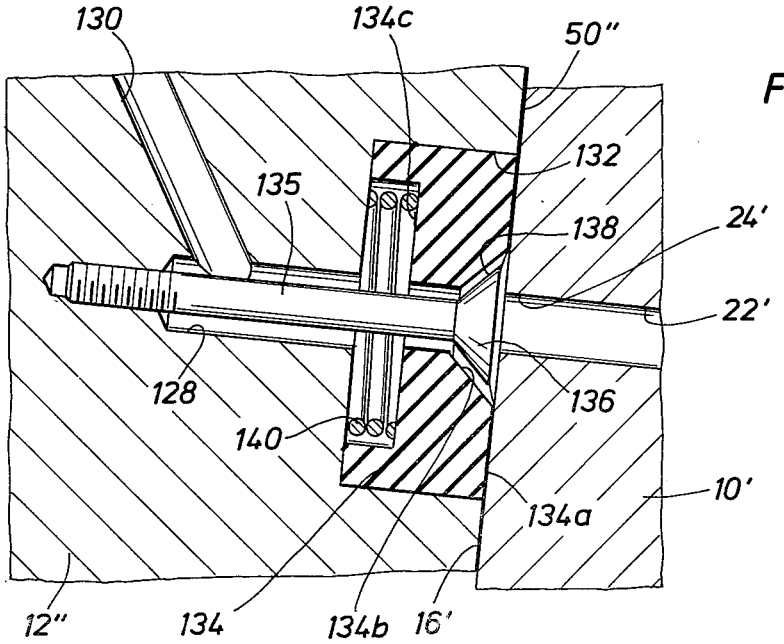
FIG. 10 is a view similar to that of FIG. 3 but showing the embodiment of FIG. 9.

Referring finally to FIGS. 9 and 10, there is shown still another embodiment including a substantially different type of valve assembly. This type of valve assembly is illustrated in the male pod only. However, it will be apparent to those of skill in the art that, with suitable modifications, similar valve assembly arrangements could be adapted for incorporation into a female pod.

Referring now to FIGS. 9 and 10 in greater detail, the female pod 10' is identical to that shown in FIGS. 2 and 3, and includes a fluid passageway 22' with a port 24' opening through the generally laterally facing wall 16' which defines the receptacle for the female pod. The male pod 12'' has a generally laterally outwardly facing side wall 50'' configured to seat on wall 16' of the female pod 10'. FIGS. 9 and 10 show a portion of one of the fluid passageways of pod 12'', that passageway having a generally transverse run 128 extending approximately perpendicular to wall 50'' and intersected near its inner end by a vertical run 130 extending upwardly and radially inwardly through pod 12'' to a suitable hydraulic line. The port for passageway 128, 130 is formed by a larger diameter counterbore 132 at the outer end of run 128.

A rod-like cylindrical support member 135 is threaded concentrically into the inner end of passageway run 128. Because the outer diameter of support member 135 is substantially less than the inner diameter of passageway run 128 (exclusive of the threaded portion), an annular flow space is provided therebetween; and because passageway run 130 communicates with run 128 outwardly of the threaded portion of the latter, run 130 communicates with this annular flow space. Integrally formed at the outer end of support member 135 is a valve seat member 136 defining a frustoconical valve seat area 138 continuous with and radiating outwardly from suport member 135, seat 138 facing inwardly with respect to port 132.

Port 132 contains an annular elastomeric seal 140, which also serves as the movable valve element of the valve assembly. Seal 134 has a body seal face 134*a* facing outwardly through port 132 for sealing engagement with wall 16' of female pod 10'. The radially inner surface of seal 134 has a frustoconical section 134*b* which forms a valve seal face opposing valve seat 134*b* for sealing engagement therewith. However, the smallest diameter of seal 134, i.e. at and adjacent the radially innermost extremity of frustoconical section 134*b*, is substantially greater than the outer diameter of support member 135 exclusive of seat member 136, so that if surface 134*b* is retracted from valve seat area 138, there is an annular flow space from the exterior of pod 12'' along members 136 and 135, to run 130 of the fluid passageway. To normally urge seal/valve element 134 to its closed position, a helical compression spring 140 is provided in port 132. One end of spring 140 bears on the shoulder formed between port 132 and the remainder of passageway run 128, while the other end extends into an axial recess 134*c* in seal 134. Additionally, the fluid pressure in passageway 62 may urge the valve to its closed position.

It can be seen that if male pod 12'' is moved downwardly from the position of FIG. 9 to the position of FIG. 10, the sliding longitudinal movement (with respect to the pods as a whole) between seal 134 and wall 16' will cause the former to be urged inwardly to the position shown in FIG. 10 thereby retracting surface 134*b* from valve seat 138 and opening passageway 128 to communication with port 24, which will then have been brought into register with port 132. It is noted that the diameter of frustoconical section 134*b* at its outermost extremity is substantially larger than the diameter of the port 24' to ensure proper communication without the necessity for any more precise placement of the ports in the two pods then is required with conventional valve-less ports. Also, as in the other embodiments, seal 134 is substantially oversized with respect to port 24' to insure that its seals about the entire periphery of port 24' even though there may be slight variations from perfect registry of the ports in the two bodies.

Although the above represent several preferred embodiments of the invention, numerous modifications will suggest themselves to those of skill in the art. Accordingly, it is intended that the scope of the invention be limited only by the claims which follow.

We claim:

1. Apparatus for connecting to a wellhead structure comprising:

a pair of matable bodies including a female body having generally laterally inwardly facing wall means defining a receptacle, and a male body adapted for insertion into and removal from said receptacle by movement in a generally longitudinal directional mode; said male body having generally laterally outwardly facing wall means for disposition adjacent said wall means of said female body when said male body is inserted therein; and each of said bodies having a respective fluid passageway therein, each of said passageways having a port opening through the respective one of said wall means, and said ports being generally in register when said bodies are matingly engaged;

and check valve means disposed in the port of one of said bodies, said check valve means being biased to a position closing said port, and comprising:

generally tubular housing means fixedly mounted in said port and defining a bore continuous with said passageway, said housing means further defining an annular valve seat area within said bore, and said bore having an enlarged diameter section adjacent said valve seat area;

a valve element reciprocably mounted within said enlarged diameter section of said bore for engagement with and retraction from said valve seat area, said valve element having an outer diameter greater than the inner diameter of said valve seat area but less than the inner diameter of said enlarged diameter section of said bore, whereby when said valve element abuts said valve seat area, said bore is blocked, and when said valve element is retracted from said valve seat area said bore is opened;

means resiliently biasing said valve element toward said valve seat area;

and actuator means movable in a generally lateral directional mode to open said port of said one body, said actuator means including a rod portion engaging said valve element and a head portion adjoining said rod portion, and when said valve element is abutting said valve seat area, protruding beyond said port of said one body for sliding engagement with the wall means of said other body, the outer diameter of said rod portion being less than the inner diameter of the surrounding portion of said bore in said housing means, and said head portion having perforation means therethrough communicating with the portion of said bore surrounding said rod portion of said actuator means.

2. The apparatus of claim 1 wherein the overall transverse extent of said perforation means of said head portion of said actuator means is substantially greater than the transverse extent of the port of said other body.

3. The apparatus of claim 2 wherein said head portion has a flat end surface facing in the same direction as said wall means and containing said perforation means.

4. The apparatus of claim 3 wherein said head portion of said actuator means is beveled adjacent the outer diameter of said end surface.

5. Apparatus for connecting to a wellhead structure comprising:

a pair of matable bodies including a female body having generally laterally inwardly facing wall means defining a receptacle, and a male body adapted for insertion into and removal from said receptacle by movement in a generally longitudinal directional mode; said male body having generally laterally outwardly facing wall means for disposition adjacent said wall means of said female body when said male body is inserted therein; and each of said bodies having a respective fluid passageway therein, each of said passageways having a port opening through the respective one of said wall means, and said ports being generally in register when said bodies are matingly engaged;

and check valve means disposed in the port of one of said bodies, said check valve means being biased to a position closing said port, and having actuator means movable in a generally lateral directional mode to open said port of said one body, said check valve means comprising:

a support member rigidly mounted within the passageway of said one body adjacent said port, the outer periphery of said support member being spaced inwardly from the inner periphery of said passageway to provide flow space therebetween;

a seat member adjoined to said support member and defining an annular seat area continuous with and radiating outwardly from said support member, said seat area facing generally inwardly with respect to said port of said one body;

an annular valve element reciprocably mounted in said port in generally surrounding relation to said support member and said seat member, and having a valve seal face facing generally outwardly with respect to said port and opposing said seat area;

means resiliently biasing said valve seal face toward said seat area;

and a portion of said valve element, when said valve seal face is abutting said seat area, protruding beyond said port of said one body to form said actuator means.

6. The apparatus of claim 5 wherein said support member defines a cylindrical surface, and said seat area is a frustoconical surface diverging from said cylindrical surface of said support member; and wherein said valve element defines a cylindrical surface, and said valve seal face is a frustoconical surface diverging from said cylindrical surface of said valve element; said cylindrical surface of said valve element generally surrounding said cylindrical surface of said support member, but being of greater diameter than said cylindrical surface of said support member.

7. The apparatus of claim 6 wherein said valve element is an elastomeric annulus having a body seal face facing outwardly from said port for sealing engagement with the wall means of said other body in generally surrounding relation to the port of said other body.

8. A connector body for connecting to a wellhead structure, said body having a wall, a fluid passageway with a port opening through said wall, and check valve means disposed in said port, said check valve means being biased to a position closing said port and comprising:

generally tubular housing means fixedly mounted in said port and defining a bore continuous with said passageway, said housing means further defining an annular valve seat area within said bore, and said bore having an enlarged diameter section adjacent said valve seat area;

a valve element reciprocably mounted within said enlarged diameter section of said bore for engagement with and retraction from said valve seat area, said valve element having an outer diameter greater than the inner diameter of said valve seat area but less than the inner diameter of said enlarged section of said bore, whereby when said valve element abuts said valve seat area, said bore is blocked, and when said valve element is retracted from said valve seat area, said bore is opened;

means resiliently biasing said valve element toward said valve seat area;

and actuator means movable transverse to said wall by virtue of movement of said body against another member in a direction generally parallel to said wall to open said port, said actuator means including a relatively narrow rod portion engaging said valve element and a relatively wide head portion adjoining said rod portion, and when said valve element is abutting said valve seat area, protruding beyond said port from said body, the outer diameter of said rod portion being less than the inner diameter of the surrounding portion of said bore in said housing means, and said head portion having perforation means therethrough communicating with the portion of said bore surrounding said rod portion of said actuator means.

9. The connector body of claim 8 wherein said head portion has a flat end surface facing in the same general direction as said wall and containing said perforation means, said head portion being beveled adjacent the outer diameter of said end surface.

* * * * *